United States Patent [19]

Santa

[11] 4,418,849

[45] Dec. 6, 1983

[54] BASEBALL GLOVE FORMER & CARRIER

[76] Inventor: Richard E. Santa, 217 West End Ave., San Rafael, Calif. 94901

[21] Appl. No.: 305,123

[22] Filed: Sep. 24, 1981

[51] Int. Cl.[3] ..... A41D 1/00; D06C 15/00; A41D 13/10

[52] U.S. Cl. ..... 223/78; 2/19; 206/278; 223/84

[58] Field of Search ..... 223/66, 78, 84; 2/19; 206/278, 292, 315 R, 315 B; 150/52 R

[56] References Cited

U.S. PATENT DOCUMENTS

| | | | |
|---|---|---|---|
| 1,168,989 | 1/1916 | Zitka | 223/84 |
| 2,757,791 | 8/1956 | Kendig | 206/292 |
| 3,811,543 | 5/1974 | Parrochia | 206/278 |
| 4,023,800 | 5/1977 | Haggerty | 206/315 R |
| 4,061,170 | 12/1977 | Marks | 206/278 |

*Primary Examiner*—Louis Rimrodt
*Attorney, Agent, or Firm*—Melvin R. Stidham

[57] ABSTRACT

A former and carrier for maintaining the shape of a baseball glove placed within it, which comprises an integral, molded plastic clam shell-like body which is closed upon the glove, maintaining pressure upon it during carrying and storage.

6 Claims, 3 Drawing Figures

BASEBALL GLOVE FORMER & CARRIER

BACKGROUND OF THE INVENTION

In the use of baseball and softball fielding gloves, it is important to the individual player that the glove be adapted to the natural, relaxed configuration of his or her hand. The stiffness of new leather makes the adaptation slow, so a new glove is usually "broken in" by oiling it with a suitable preservative oil such as linseed, neatsfoot, and the like. After continued use, the glove will adapt in its open position to the natural, relaxed position of the player's hand. Equally important to the use of the glove, is the development of a natural crease in the glove, usually extending from the bottom corner of the glove away from the thumb and through the ball pocket and diagonally upward to the webbing which connects the thumb and index finger of the glove. This crease facilitates closing of the webbing and fingers of the glove about the ball as it enters the pocket to hold the ball firmly within the pocket. It is thus important that the integrity and position of the crease be maintained while the glove is not in use.

It is also important that the hemispherical shape of the ball pocket itself be maintained during storage and that means be provided for convenient storage of the glove while protecting it from weathering and abrasion.

OBJECTS OF THE INVENTION

It is an object of this invention to provide a convenient means for forming a baseball glove.

It is a further object of this invention to provide a baseball glove former and storage container, which maintains the configuration of the glove desired by the player.

Other objects and advantages of this invention will become apparent from the description to follow, particularly when read in configuration with the accompanying drawing.

SUMMARY OF THE INVENTION

In accordance with the present invention, a carrier for the transportation, storage, and preservation of the shape of a ball glove is provided. The former comprises an integrally-molded, elastic plastic body having a clam shell-like configuration, being defined by an integral hinge portion and two substantially identical side panels extending perpendicularly from and rotatable about said hinge portion. The side panels are hingedly connected along one side of each to a generally triangular retaining web which partially closes one end of the former and provides a means of properly positioning and holding a glove within the former. Handle means are provided along the top edge of each side panel to facilitate carrying. The dimensions of the former are such that when a glove is placed in it, with the heel of the glove disposed against the retaining web, a substantial portion of the glove, including most of the fingers will be covered. The dimensions of the former are also such that when the former is in closed configuration sufficient pressure will be imparted to and maintained against the back sides of a ball glove which is folded along the naturally developed crease line and held within the former to maintain the crease when the glove is stored.

DESCRIPTION OF A PREFERRED EMBODIMENT

Figures 1, 2, 3:
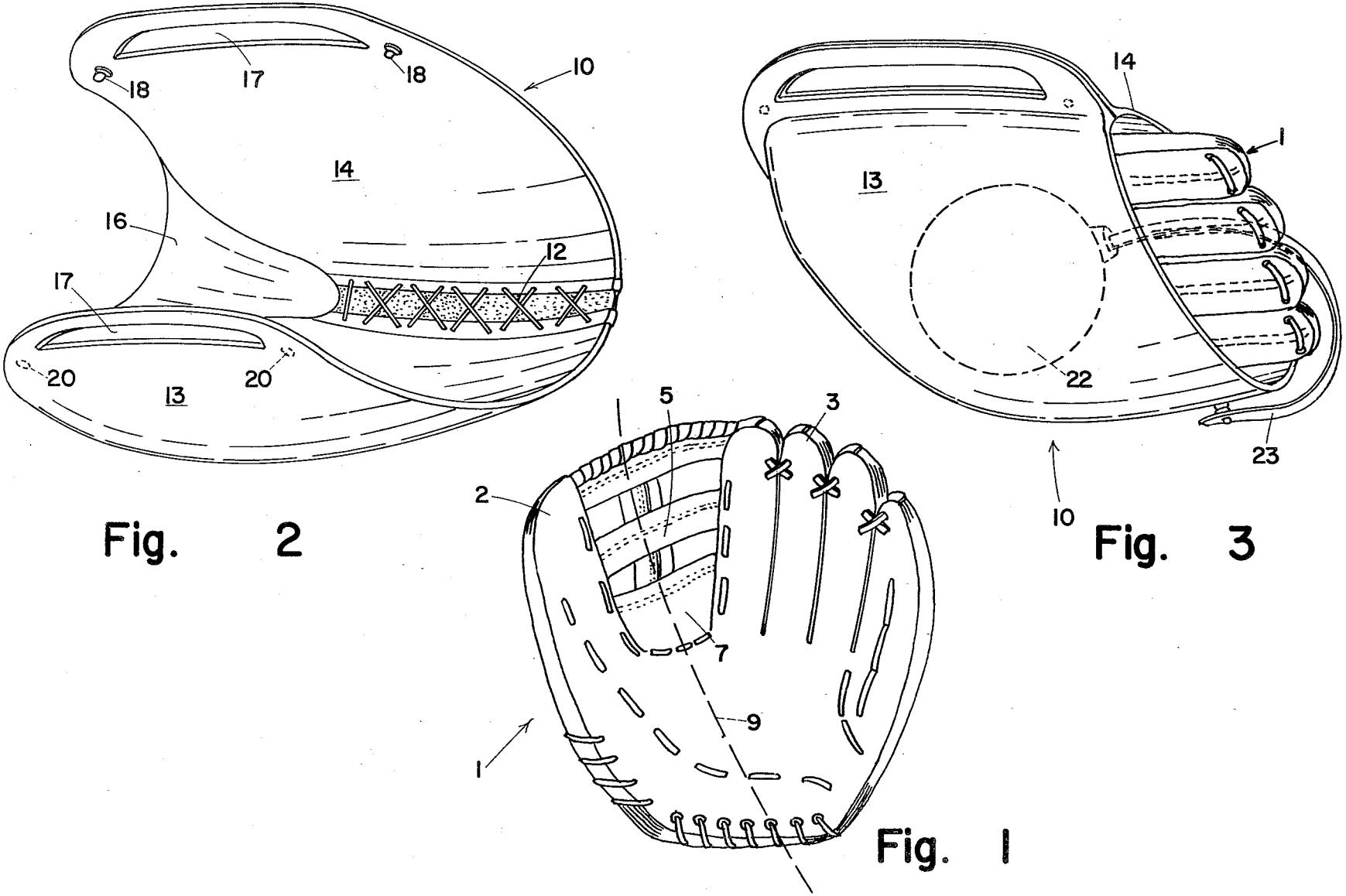
FIG. 1 is a view in perspective of a typical baseball fielder's glove.
FIG. 2 is a view in perspective of the former of this invention in its open configuration.
FIG. 3 is a view in perspective of the former and carrier in closed configuration around a baseball fielder's glove.

Referring first to FIG. 1, there is shown a typical baseball fielder's glove 1 including a thumb 2, fingers 3 and interconnecting webbing 5. The glove is formed with a central depressed area or pocket adjacent the webbing 5, and to maximize use of the webbing 7 and pocket 5, glove 1 is provided with a natural fold line indicated by dotted line 9 so that the webbing 5 forms a natural extension of the pocket.

The baseball glove former 10 is shown in open position in FIG. 2, and comprises a hinge portion 12, and opposing side panels or body sections 13 and 14, which are interconnected at one end by a flexible retaining web 16. Handle openings 17 may be provided in the side panels 13 and 14, and male and female snap fasteners 18 and 20 may be provided in the side panels to secure them together when they are closed over a baseball glove, as shown in FIG. 3.

A ball 22 of plastic or the like and of the size of a baseball is an optional feature which may be carried on a strap 23 secured to the former 10. Thus, in use the ball 22 may be inserted in the pocket 7 and the glove 1 folded around it, so that the former 10 serves to maintain both the natural fold along line 9, and the pocket 7 itself. In this connection it should be noted that the terms "baseball" and "baseball glove" are intended to cover corresponding equipment for softball, stickball and related games and sports.

While snaps 18, 20 or other fastening means are shown to hold the panels 13 and 14 together the side panels 13 and 14, as well as the hinge portion 12, may simply have sufficient flexural restoration to be separated for insertion of the glove 1 and then to snap back and clamp around it to maintain a slight camping force around the folded glove.

While this invention has been described in conjunction with a preferred embodiment thereof, it obvious that modifications and changes therein may be made by those skilled in the art to which it pertains without departing from the spirit and scope of this invention, as defined by the claims appended hereto.

What is claimed as invention is:

1. A former and carrier for baseball glove formed in two sections hinged about a natural crease extending downward from between thumb and forefinger to the heel thereof, said former end carrier comprising:

a clam shell-like, integrally molded, elastic plastic body, having opposing side panels and an intermediate hinge portion;

each of said panels being of a size and shape to accommodate one section only of a baseball glove folded about said natural crease with the back of said glove along said natural crease overlying and disposed along said hinge portion; and means forcing said side panels toward each other so that sufficient pressure is applied and maintained upon a glove contained therebetween to preserve the location and integrity of said natural crease.

2. The former and carrier defined by claim 1 including:

opposing handle appertures in said side panels along the distal edges thereof.

3. The former and carrier defined by claim 2 in sphere;

a substantially non-yielding ball corresponding in size to a sport ball;

an elongated flexible member secured at one end to the carrier body, and at the other end to said ball, said member being of sufficient length to allow insertion of the ball into the pocket of a glove disposed within the closed former and carrier to maintain the shape and integrity of pocket in the palm thereof.

4. The former and carrier defined by claim 3 wherein: said ball corresponds in size to a baseball.

5. The former and carrier defined by claim 3 wherein: said ball corresponds in size to a softball.

6. The former and carrier defined by claim 1 wherein: said forcing means are opposing interlocking fastening means on said side panels.

* * * * *